US009015980B2

(12) United States Patent
Shull

(10) Patent No.: US 9,015,980 B2
(45) Date of Patent: Apr. 28, 2015

(54) FOLDING GRIP FOR A FIREARM

(71) Applicant: Zachariah T. Shull, Hamilton, IN (US)

(72) Inventor: Zachariah T. Shull, Hamilton, IN (US)

( * ) Notice: Subject to any disclaimer, the term of this patent is extended or adjusted under 35 U.S.C. 154(b) by 27 days.

(21) Appl. No.: 13/765,259

(22) Filed: Feb. 12, 2013

(65) Prior Publication Data

US 2013/0205636 A1 Aug. 15, 2013

Related U.S. Application Data

(60) Provisional application No. 61/598,082, filed on Feb. 13, 2012.

(51) Int. Cl.
*F41C 23/00* (2006.01)
*F41C 23/04* (2006.01)
*F41C 23/16* (2006.01)

(52) U.S. Cl.
CPC ..... *F41C 23/04* (2013.01); *F41C 23/16* (2013.01)

(58) Field of Classification Search
CPC ..... F41C 23/16; F41C 23/04; F41C 23/14; F41G 11/003
USPC ..... 42/90, 93, 94; 73/167; 89/40.06; 248/163.1
See application file for complete search history.

(56) References Cited

U.S. PATENT DOCUMENTS

| | | | | |
|---|---|---|---|---|
| 2,547,180 | A | 12/1948 | Taylor | |
| 3,999,461 | A * | 12/1976 | Johnson et al. | 89/191.01 |
| 4,351,224 | A * | 9/1982 | Curtis | 89/37.04 |
| 5,946,842 | A | 9/1999 | Nyzell et al. | |
| 6,289,622 | B1 * | 9/2001 | Desch et al. | 42/94 |
| 6,785,997 | B2 * | 9/2004 | Oz | 42/94 |
| 7,222,451 | B2 * | 5/2007 | Keng et al. | 42/94 |
| 7,434,344 | B2 | 10/2008 | Golan | |
| 7,631,455 | B2 * | 12/2009 | Keng et al. | 42/94 |
| 7,793,454 | B1 * | 9/2010 | Beltz | 42/94 |
| 7,841,120 | B2 * | 11/2010 | Teetzel et al. | 42/72 |
| D650,881 | S * | 12/2011 | Abbott et al. | D22/108 |
| 8,402,684 | B1 * | 3/2013 | Beltz | 42/94 |
| 8,567,106 | B2 * | 10/2013 | Chvala | 42/94 |
| 2004/0060222 | A1 * | 4/2004 | Oz | 42/146 |
| 2005/0241206 | A1 * | 11/2005 | Teetzel et al. | 42/72 |
| 2011/0030258 | A1 | 2/2011 | Fistikchi et al. | |

* cited by examiner

*Primary Examiner* — Samir Abdosh
(74) *Attorney, Agent, or Firm* — Barnes & Thornburg LLP

(57) ABSTRACT

The present disclosure provides a gun having an off-hand grip adjustably coupled to a handguard and spaced apart from a grip with a trigger located between the grip and the off-hand grip. The off-hand grip has a first end and a second end that is distal from the first end. The off-hand grip includes a pivot located adjacent the first end such that the off-hand grip is pivotable with respect to the handguard. The off-hand grip is also pivotable between a use position where the off-hand grip longitudinally extends about transverse from the barrel, and a stowed position where the off-hand grip is longitudinally adjacent the barrel.

8 Claims, 10 Drawing Sheets

FOLDING GRIP FOR A FIREARM

RELATED APPLICATIONS

The present application is related to and claims priority to U.S. Provisional Patent Application, Ser. No. 61/598,082, filed on Feb. 13, 2012, entitled "Folding Grip for a Firearm." The subject matter disclosed in that provisional application is hereby expressly incorporated into the present application.

TECHNICAL FIELD AND SUMMARY

The present disclosure relates to firearms including long guns, and more particularly to a pivotable off-hand grip for the long gun that is movable between use and stowed positions.

Long guns, such as rifles and shotguns, typically have a shoulder or butt stock, a receiver or breech mechanism attached to a forward end of the butt stock, and a barrel attached to the forward end of the receiver or breech mechanism. The receiver typically includes a trigger assembly, a firing pin, and a fixed or reciprocating bolt or breech block. The receiver may also include a magazine well for accepting a magazine containing a supply of ammunition.

A fore stock or handguard is typically provided adjacent the breech or receiver end of the barrel to accommodate the off-hand (i.e., non-trigger hand) of the shooter. The fore stock or handguard for shotguns and "traditional" sporting rifles is typically made of wood, and in some instances is integrally formed with the shoulder stock. Handguards are also formed of metals, thermoplastics and other materials, and are not always integrally formed with other major components of the firearm.

As the name implies, the handguard provides a location for the off-hand to support the gun while providing protection from a hot barrel. Typically, these handguards are configured generally parallel with the barrel. This causes the off-hand to orient the handguard also, generally, parallel to the barrel. This means the trigger hand is supporting the gun generally transverse to the barrel while the off-hand is supporting the gun generally parallel to the barrel. In some instances it may be desirable to support the gun where both grips (trigger and off-hand) are generally transverse to the barrel. Transversely-oriented, off-hand grips are available but they mount to the handguard using fasteners. They are simply attachable and detachable. They do not conveniently move out of the way if not in use.

In contrast, the present disclosure provides an off-hand grip for a handguard that pivots between use and stowed positions. When in-use position, the off-hand grip is oriented generally transverse to the barrel and available to be grasped. When in stowed position, the off-hand grip is oriented generally parallel to either or both the barrel and handgrip. In either case, the off-hand grip is not removed to move it between use and stowed positions. Instead, the off-hand grip is pivoted between these two positions.

An illustrative embodiment of the disclosure provides a gun comprising: a hand grip attached to a body and located adjacent a trigger, a firing mechanism attached to the body, and a barrel extending from the firing mechanism; a handguard located adjacent the barrel; a stowable, longitudinally-extending, off-hand grip adjustably coupled to the handguard and spaced apart from grip with the trigger located between the grip and the off-hand grip; wherein the off-hand grip has a first end, and a second end that is distal from the first end; wherein the off-hand grip includes a pivot located adjacent the first end such that the off-hand grip is pivotable with respect to the handguard; and wherein the off-hand grip is pivotable between a use position where the off-hand grip longitudinally extends about transverse from the barrel, and a stowed position where the off-hand grip is longitudinally adjacent the barrel.

In the above and other embodiments, the gun may also comprise: a bar about which the off-hand grip pivots; the off-hand grip including an indexing block at one end, wherein the indexing block includes the first and second notches, wherein a bar is disposed therethrough and about which the off-hand grip pivots; a locking block located between the barrel and the handguard, wherein the locking block is coupled to the bar and movable with the bar as the bar engages and disengages to and from either the first or second notch; the indexing block being U-shaped and configured to receive a portion of the locking block when the bar is engageable with at least the first notch; and a portion of the bar being located exterior of the handguard, and wherein the bar is configured to be movable with respect to the indexing block by the portion of the bar-located exterior of the handguard.

Another illustrative embodiment provides a gun that comprises: a hand grip attached to a body and located adjacent a trigger, a firing mechanism attached to the body, and a barrel extending from the firing mechanism; a handguard located adjacent the barrel; a stowable, longitudinally-extending, off-hand grip adjustably coupled to the handguard and spaced apart from grip with the trigger located between the grip and the off-hand grip; wherein the off-hand grip has a first end, and a second end that is distal from the first end; wherein the off-hand grip includes a pivot located adjacent the first end such that the off-hand grip is pivotable with respect to the handguard; wherein the off-hand grip is pivotable between a use position where the off-hand grip longitudinally extends about transverse from the barrel, and a stowed position where the off-hand grip longitudinally adjacent the barrel; wherein the off-hand grip includes a first notch, and second notch spaced apart from the first notch; a bar located adjacent the handguard and movable with respect to the off-hand grip; wherein the bar is engageable with the first notch when the off-hand grip is located in the use position and the bar is engageable with the second notch when the off-hand grip is located in the stowed position; and wherein the bar is selectively movable to disengage from the first and second notches which allows the off-hand grip to pivot between the use and stowed positions.

In the above and other embodiments, the gun may also comprise: a bar about which the off-hand grip pivots; the off-hand grip including an indexing block at one end, wherein the indexing block includes the first and second notches, wherein a bar is disposed therethrough and about which the off-hand grip pivots; a locking block located between the barrel and the handguard, wherein the locking block is coupled to the bar and movable with the bar as the bar engages and disengages to and from either the first or second notch; the indexing block being U-shaped and configured to receive a portion of the locking block when the bar is engageable with at least the first notch; and a portion of the bar being located exterior of the handguard, and wherein the bar is configured to be movable with respect to the indexing block by the portion of the bar located exterior of the handguard.

Additional features and advantages of the gripper assembly will become apparent to those skilled in the art upon consideration of the following detailed description of the illustrated embodiment exemplifying the best mode of carrying out the folding grip for a firearm as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the gun, and such exemplification is not to be construed as limiting the scope of the gun in any manner.

DETAILED DESCRIPTION OF THE DRAWINGS

Figure 1:
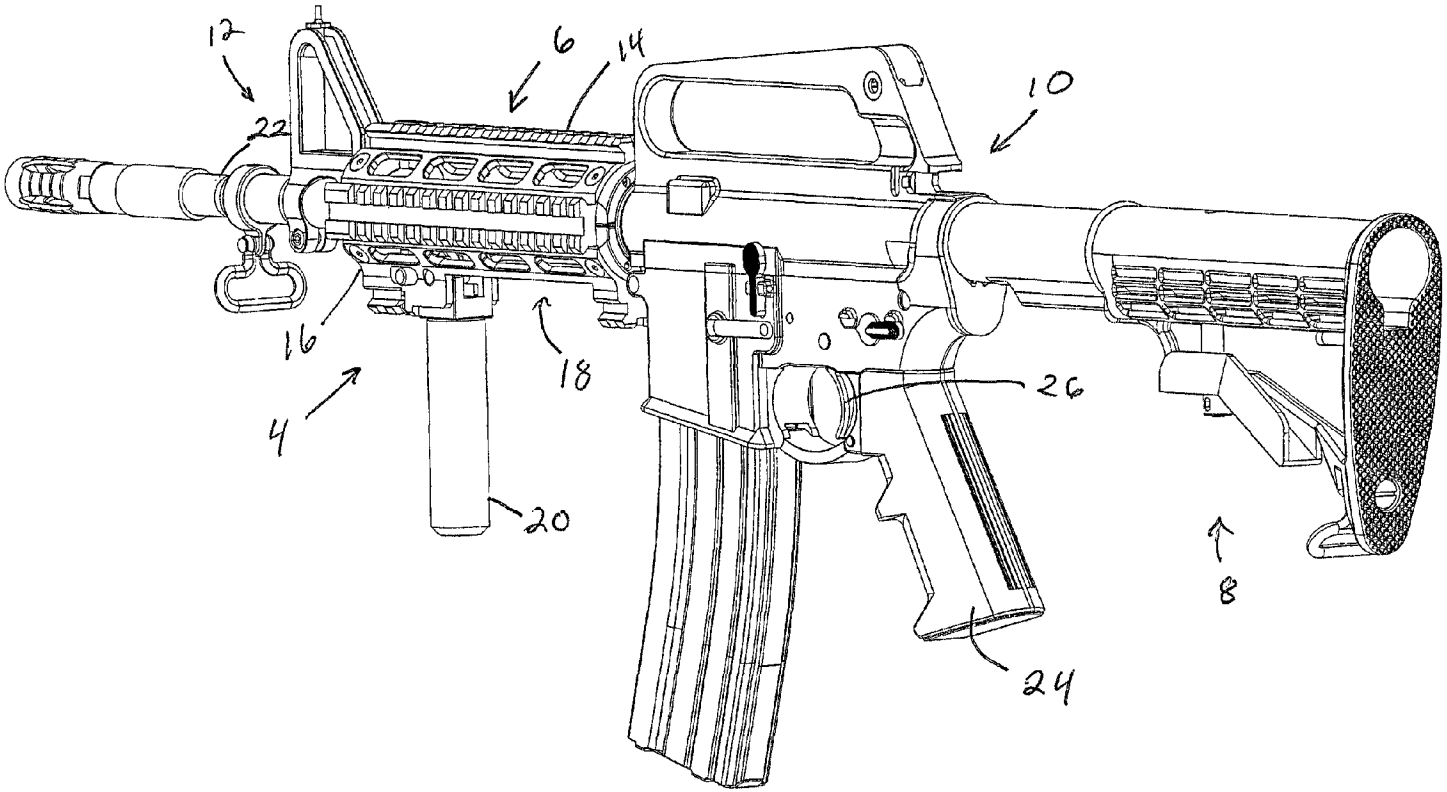
FIG. 1 is a perspective view of an AR-15-type rifle that includes a folding off-hand grip assembly located in a use position.

A perspective view of gun 2 that includes an off-hand grip assembly 4 is shown in FIG. 1. Gun 2 is illustratively an AR-15-type rifle. It is appreciated, however, that other types of long guns that both look like the gun shown as well as those that do not include off-hand grip assembly 4. For example, some 22 caliber rifles look similar to gun 2, particularly in that they include a handguard not dissimilar to the handguard assembly 6.

A shotgun having a handguard adjacent its barrel may be adapted to include off-hand grip assembly 4. The particular gun 2 shown includes a butt stock 8, a receiver 10, and a barrel assembly 12. Part of barrel assembly 12 includes the handguard assembly 6. In this illustrative embodiment, handguard assembly 6 includes upper handguard component 14 and lower handguard component 16. In an illustrative embodiment, lower handguard component 16 includes a recessed opening or cut out 18 configured to receive off-hand grip assembly 4. In this view, off-hand grip assembly 4 is shown located in its use position. This means hand grip portion 20 extends generally vertically or transverse to barrel 22 of gun 2. This makes grip 20 available to be grasped by the off-hand of the shooter. It is appreciated from this view how the off-hand does not need to be oriented parallel to the barrel to grasp the handguard-portion of the gun, but instead can be oriented transverse similar to how a trigger hand would grip trigger grip 24 located adjacent trigger 26 on gun 2.

Figure 2:
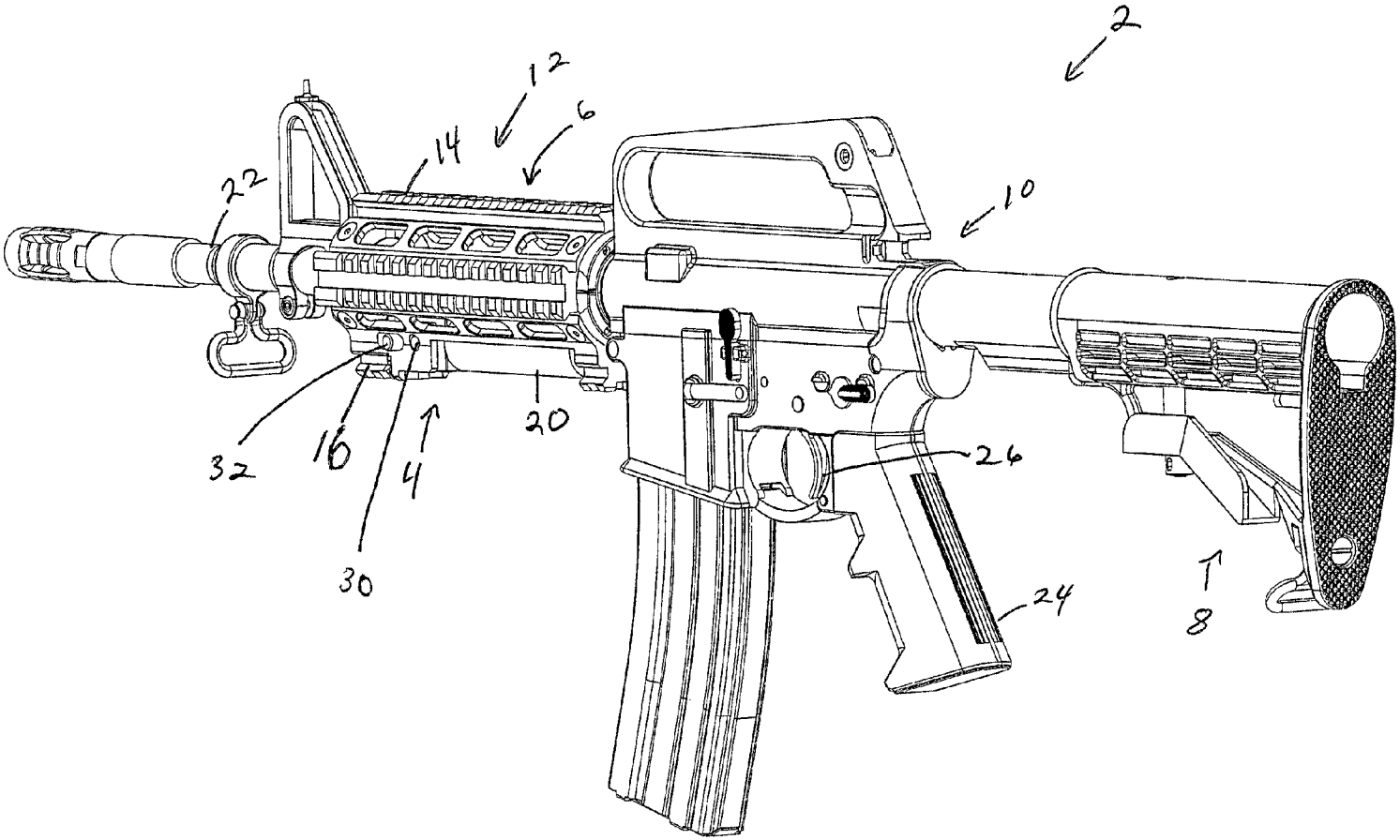
FIG. 2 is another perspective view of the AR-15-type rifle as shown in FIG. 1, except with the off-hand grip assembly folded to a stowed position.

The perspective view of gun 2 shown in FIG. 2 also includes butt stock 8, receiver 10, barrel assembly 12, handguard assembly 6, trigger grip 24, and trigger 26. In this view, however, off-hand grip assembly 4 is located in its stowed position where grip 20 is fitted adjacent lower handguard component 16. In contrast to that shown in FIG. 1, grip 20 in FIG. 2 is pivoted about pivot bar or pin 30 up to its stowed position as shown. A release valve 32 illustratively extends from handguard assembly 6 so when engaged it will allow grip 20 to pivot or otherwise move between the stowed position shown in FIG. 2 and the use position shown in FIG. 1. It is appreciated that with grip 20 located in the stowed position, the off-hand may support gun 2 at the handguard by supporting handguard assembly 6 as if off-hand grip assembly 4 was not present. Furthermore, it is appreciated that when referring to the location of grip 20 being vertical/transverse or parallel/adjacent either the handguard assembly 6 or barrel 22 encompasses more than a strict 90 degree of 180 degree relationship. It is appreciated the scope of these terms encompasses a wider breadth of angles and can simply be more transverse than parallel to mean transverse, and more parallel than transverse to mean parallel. In any event, it is appreciated when comparing FIGS. 1 and 2 how grip 20 of off-hand grip assembly 4 does not have to be disconnected from gun 2 in order to be moved out of the way. Rather, pivoting grip 20 upwards toward lower handguard component 16 accomplishes the same goal without removing grip 20 at all.

Figure 3:
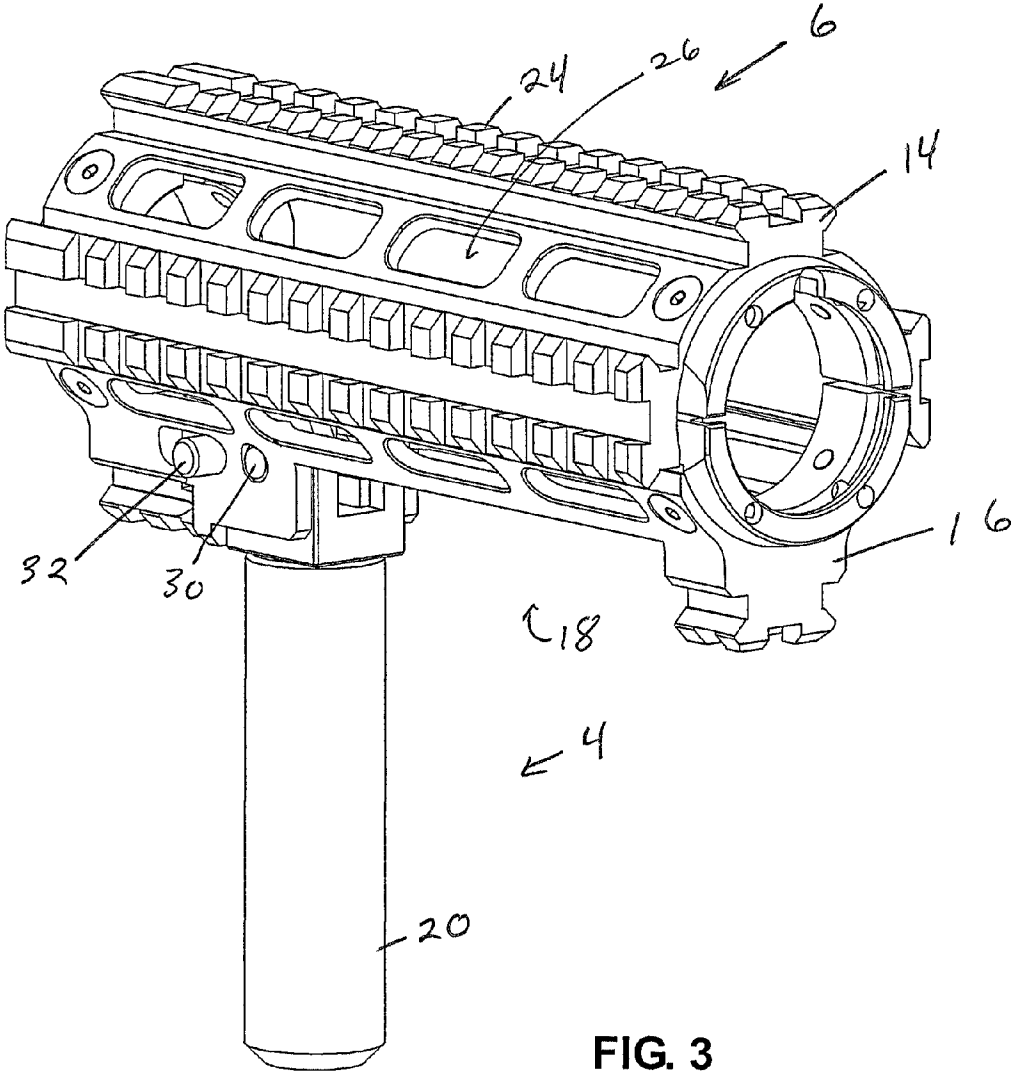
FIG. 3 is a perspective view of a handguard portion of a gun with the folding off-hand grip assembly located in its use position.

Off-hand grip assembly 4 located in its use position with respect to illustrative handguard assembly 6 is shown in perspective view in FIG. 3. This view further demonstrates how grip 20 extends generally transverse from assembly 6. This view also shows pivot pin 30 and release dowel 32 used to pivot and release grip 20, respectively. Handguard assembly 6, also shown, includes upper handguard component 14 and lower handguard component 16 along with cut out 18. It is appreciated that handguard assembly 6 is illustrative only and off-hand grip assembly 4 is not limited to the exact configuration of handguard assembly 6 shown. For example, off-hand grip assembly 4 may be attached to a handguard configuration that includes only a lower handguard portion such as that employed on a conventional shotgun. Further, assembly 4 may be attached to a bracket on the barrel itself or a handguard assembly that does not include gripping ridges such as ridges 24 or openings 26 as shown. Off-hand grip assembly 4 is spaced apart from the trigger grip to accommodate the off-hand. The illustrative embodiment shown provides a useful structure to attach assembly 4 to in order to allow assembly 4 to pivot between use and stowed portions and which is conventionally an area supported by the off-hand. In the illustrative embodiment, cut-out 18 shown in lower handguard portion 16 allows grip 20 to be located generally flush with the bottom of component 16.

Figure 4:
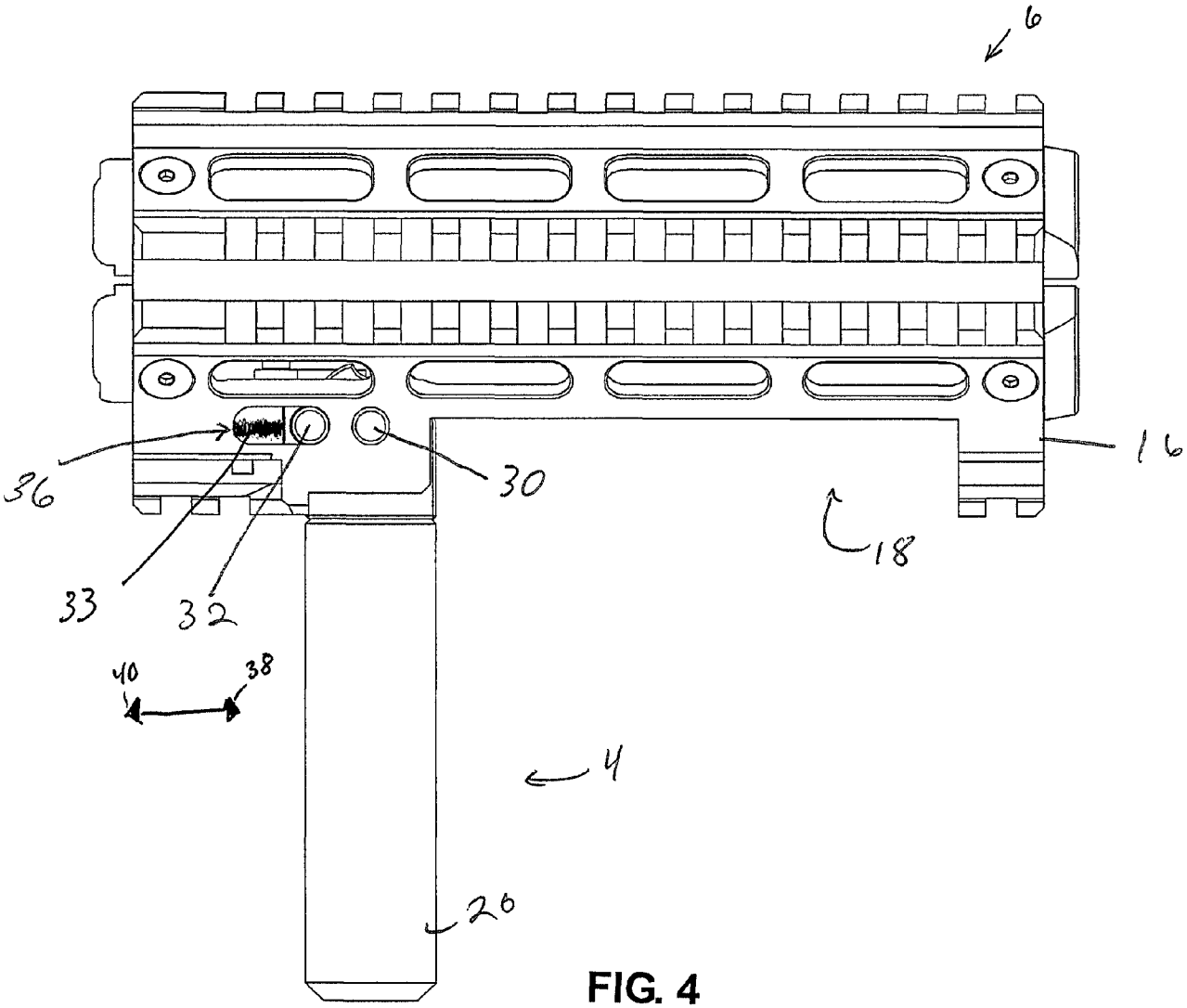
FIG. 4 is a side view of the handguard of FIG. 3 also showing the off-hand grip assembly located in its use position.

A side view of off-hand grip assembly 4 located in its use position with respect to illustrative handguard assembly 6 is shown in FIG. 4. This view further shows relative locations of pivot pin 30 and release dowel 32. A spring 33 is coincidentally shown through slot 36. Spring 33 is configured to bias dowel 32 in direction 38 to help hold grip 20 in place as discussed further herein. Also shown is illustrative cut-out 18 and lower handguard component 16. This view depicts how when grip 20 is in its use position it is located transverse to the longitudinal extent of handguard assembly 6.

Figure 5:
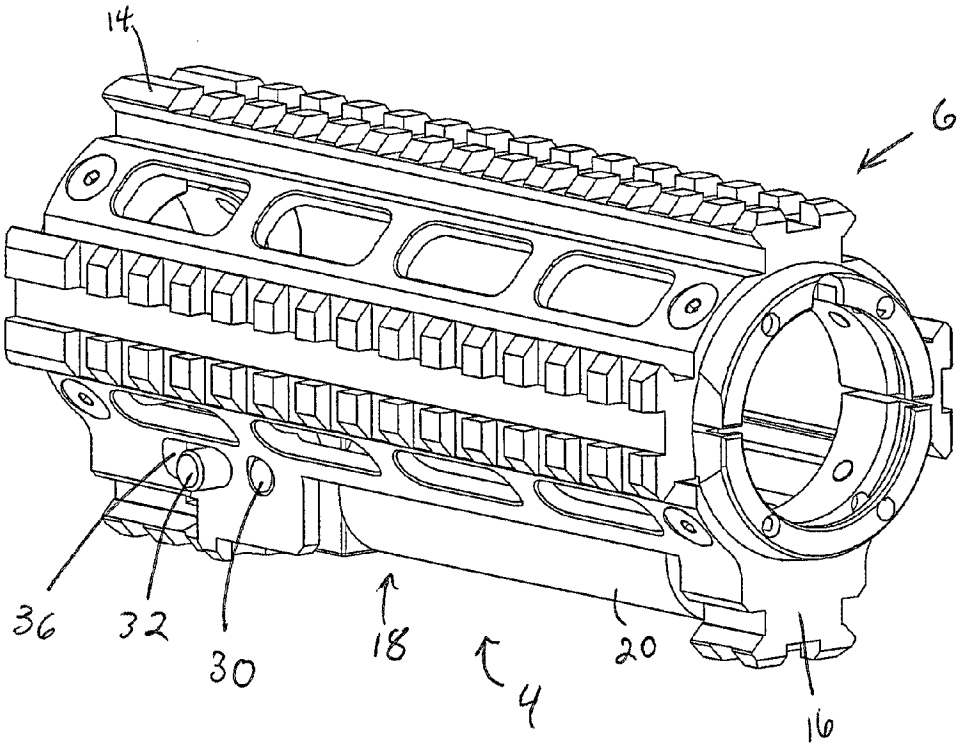
FIG. 5 is a perspective view of the handguard of FIGS. 3 and 4, except showing the off-hand grip assembly folded-up and located in its stowed position.

In contrast to FIG. 3, FIG. 5 shows a perspective view of off-hand grip assembly 4 but in its stowed position with respect to handguard assembly 6. This view demonstrates how grip 20 may pivot about pin 30 to move to cut-out 18 to this stowed position. It is further appreciated in this view how handguard 6 with grip 20 may be used to support a gun by the off-hand in a conventional manner. As discussed further, to move grip 20, release dowel 32 is moved in slot 36 against the bias of spring 33 thereby releasing grip 20 and allowing it to move to the shown stowed position.

Figure 6:
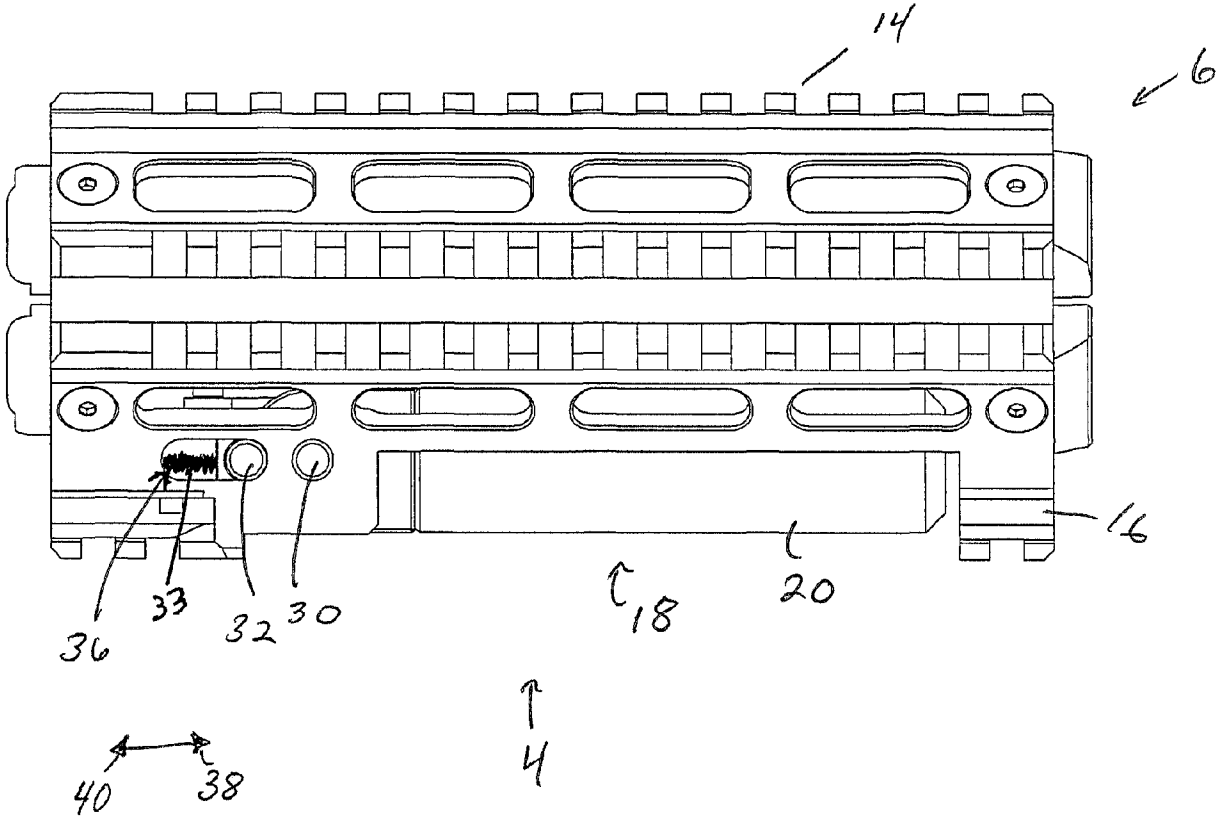
FIG. 6 is a side view of the handguard of FIG. 5 also showing the off-hand grip assembly located in its stowed position.

Off-hand grip assembly 4 located in its stowed position with respect to handguard assembly 6 is shown in FIG. 6. In this illustrative embodiment, it is appreciated how handle 20 may be figured to create a generally flush surface to the bottom surface of lower handguard component 16. It is also appreciated that when identifying the surfaces as flush, they do not have to be precisely flush as the drawing demonstrates. This view does, however, show that when in its stowed position, grip 20 is out of the way allowing the handguard to be grasped in an otherwise conventional manner by the off-hand. This view also makes it easier to appreciate how release dowel 32 is moved within slot 36 against the bias of spring 33 in direction 40 to release grip 20, allowing it to move between stowed and use positions.

Figure 7:
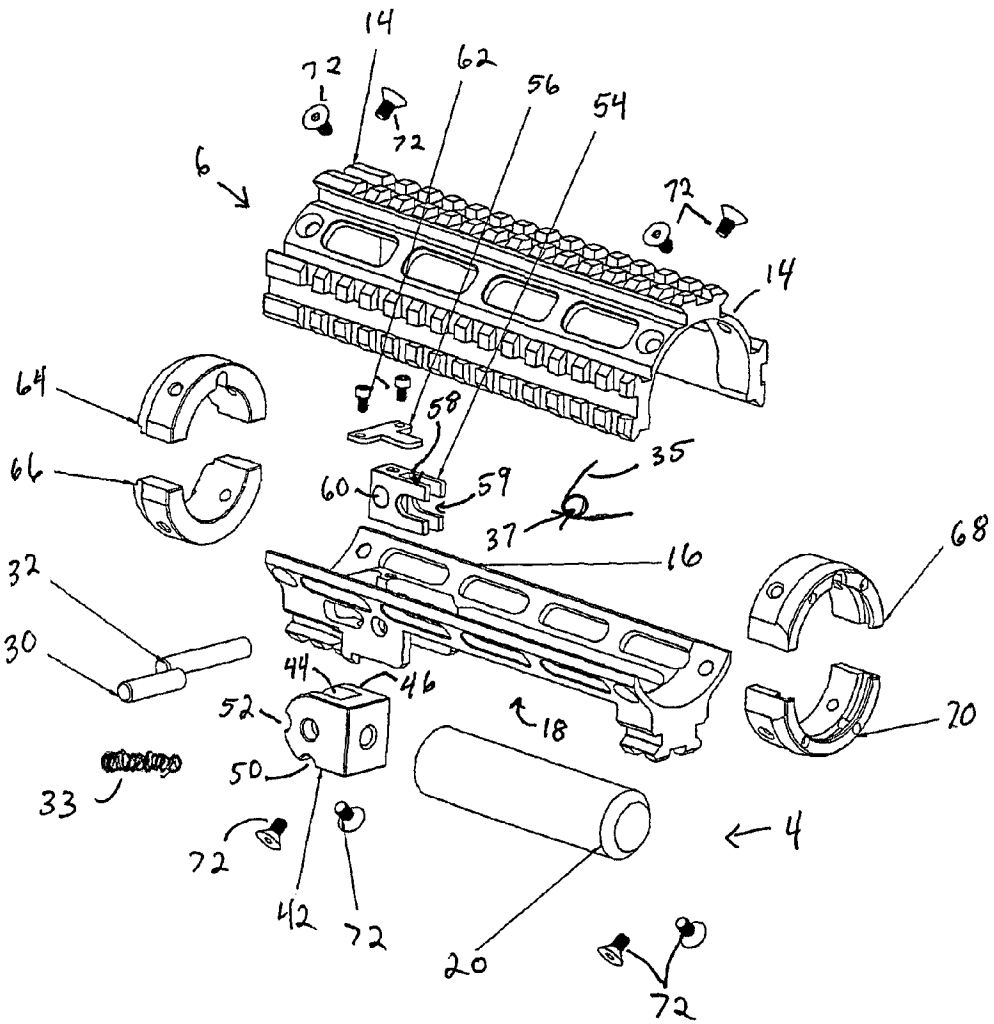
FIG. 7 is an exploded view of the off-hand grip assembly along with an illustrative handguard assembly.

An exploded view of off-hand grip assembly 4 is shown in FIG. 7. This view shows an exploded view of an illustrative embodiment of hand grip assembly 6 as well. Again, it is appreciated that off-handguard assembly 6 is included for illustrative purposes. This view shows grip 20 attachable to indexing block 42. In this embodiment, indexing block 42 is illustratively U-shaped and includes a slot 44 and a bore configured to receive pivot bar or pin 30 as well as a fastener to connect it with grip 20. It is further appreciated that grip 20 may be attached to indexing block 42 via several conventional mechanisms. Each wall 46 and 48 of indexing block 42 also includes a notch 50 and 52. Notches 50 are configured to engage release dowel 32 when grip 20 is in the use position and engage notches 52 when in the stowed position. Spring 33 pushes against dowel 32 which in-turn keeps dowel 32 seated in either notches 50 or 52. When grip 20 is needed to be moved between stowed and use position release dowel 32 is pulled in direction 40 (see, also, FIG. 6) against the bias of spring 33 to pull dowel 32 out of either notches 50 or 52. This allows grip 20 to move in directions 74 or 76 (see, also, FIGS. 9 and 10).

This view also shows a locking block 54 and a cover plate 56. Locking block 54 is configured to be located in slot 44 of indexing block 42. Locking block 54 includes slot 58, channels 59, and a bore 60 to receive pivot pin 30 and release pin 32, respectively. A torsion spring 35 illustratively fits about pin 30 and biases against both cover plate 58 and indexing block 42. This creates a bias on grip 20 to the use position.

Illustrative handguard assembly 6 includes upper handguard component 14 and lower guard component 16 that fit together and couple to rings 64, 66, 68 and 70 via fasteners 72. It is again appreciated that the hand grip assembly shown is illustrative and other hand grip designs may serve the same purpose. Cut-out 18 in lower handguard component 16 may be configured to receive indexing block 42 along with locking block 54 and cover plate 56.

Figure 8:
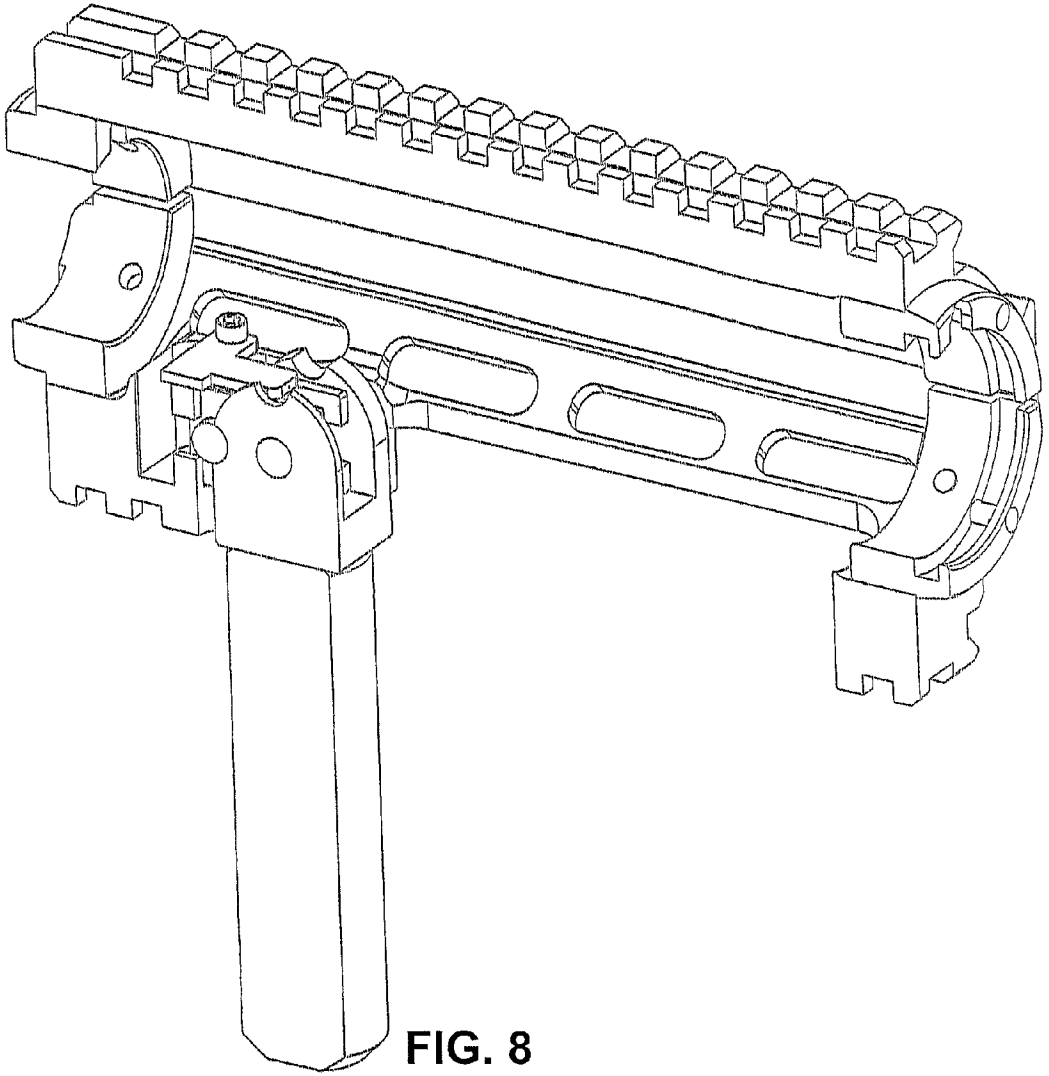
FIG. 8 is a perspective-cross sectional view of the off-hand grip assembly located in the use position and coupled to an illustrative handguard assembly.
Figure 9:
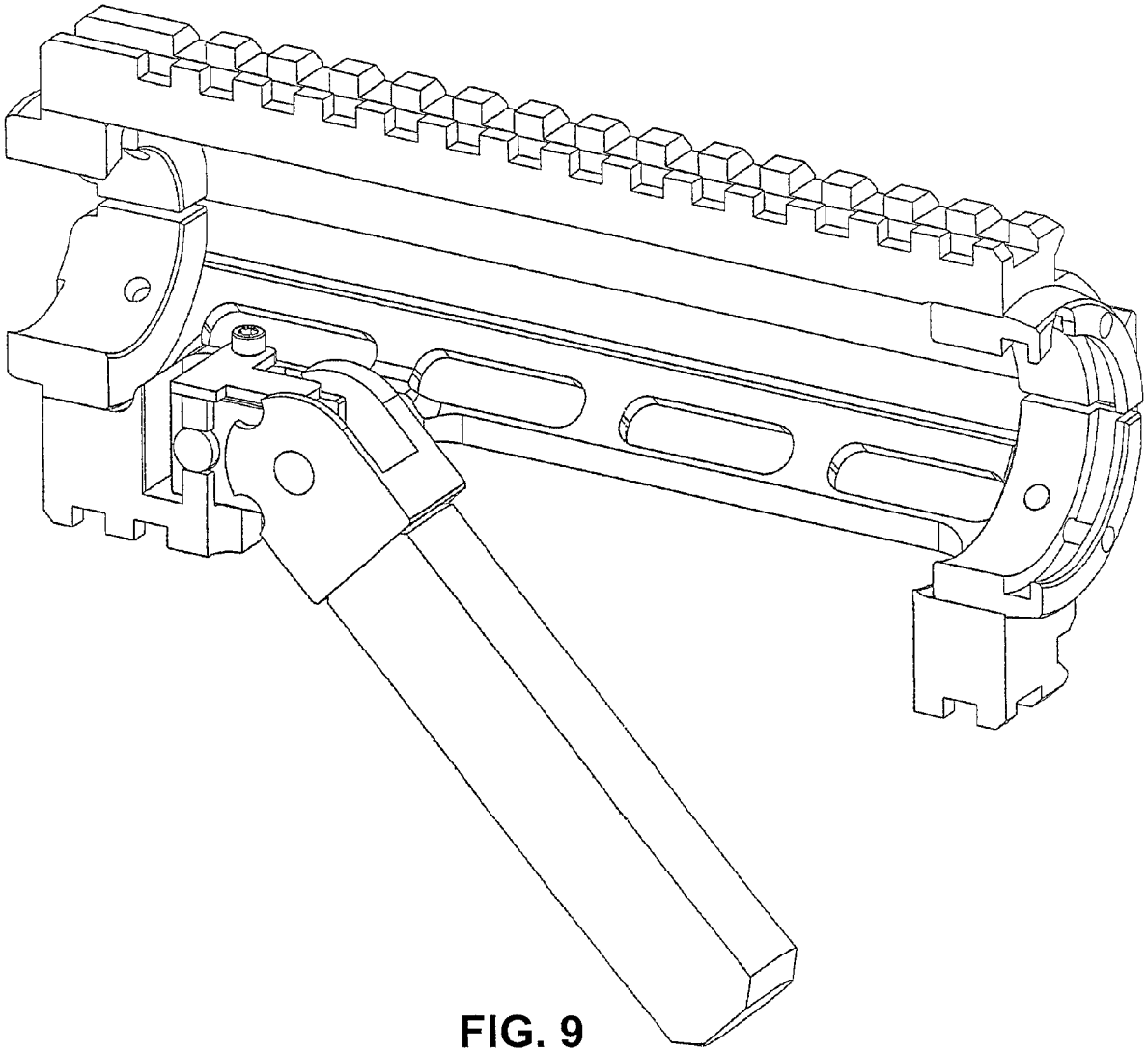
FIG. 9 is another perspective-cross sectional view of the off-hand grip moving from its use position as shown in FIG. 8 to its stowed position as shown in FIG. 10.
Figure 10:
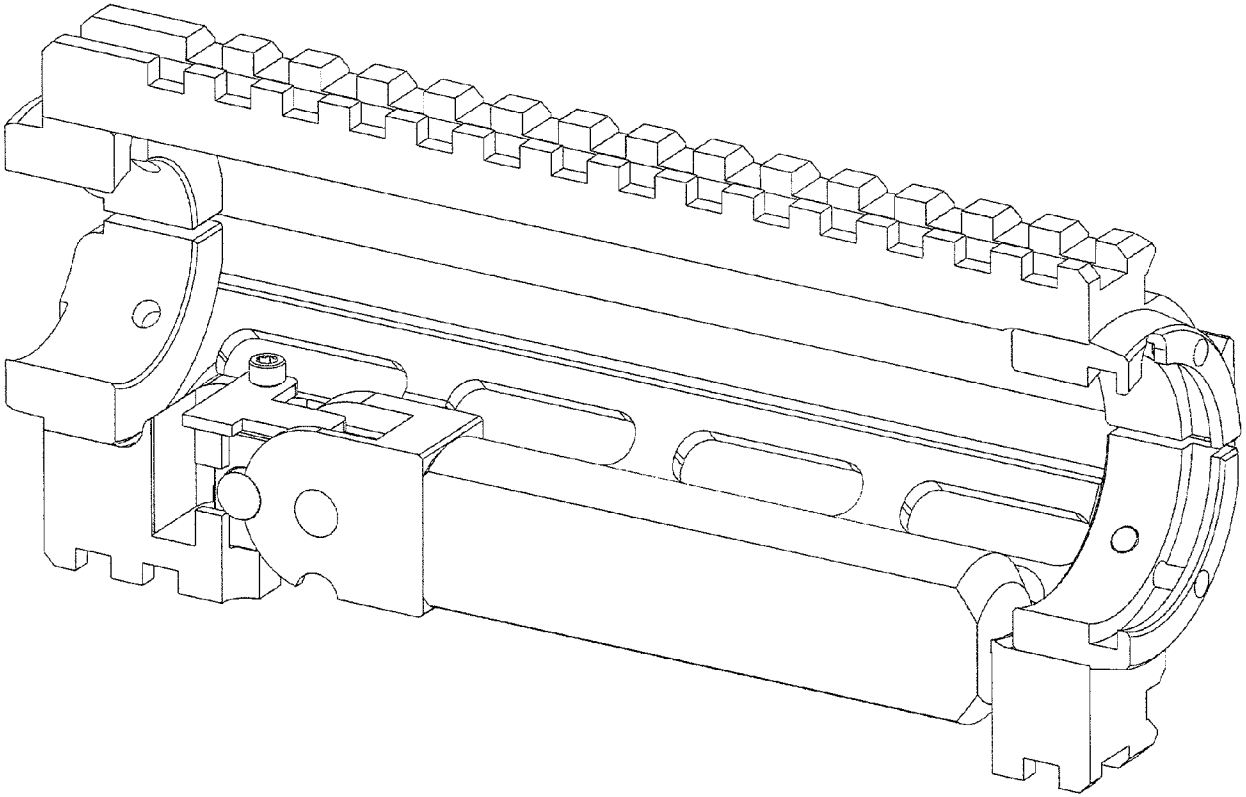
FIG. 10 is another perspective-cross sectional view of the off-hand grip assembly moved to its stowed position from its use position in FIG. 8 through its intermediate position shown in FIG. 9.

Perspective-cross sectional views of handguard assembly 6 showing the progression of movement of off-hand grip assembly 4 between use and stowed positions is shown in FIGS. 8 through 10. As shown in FIG. 8, grip 20 is located in its use position generally transverse to handguard assembly 6. Indexing block 42 is attached to grip 20 and has pivot pin 30 disposed therethrough. Release dowel 32 is seated in notch 50, and with the bias of spring 33, keeps grip 20 secure in place. Torsion spring 35 (shown in partial ghost view) is configured to bias against both cover plate 58 and indexing block 42 as shown. This causes grip 20 to securely hold in this use position.

When grip 20 is moved to its stowed position, as shown in FIG. 9, release dowel 32 is pulled in direction 40 against the bias force of spring 33. This pulls locking bracket 54 in direction 40 as well causing release dowel 32 to remove itself from notches 50. Indexing block 42 and grip 20 are now pivotable with respect to handguard assembly 6. Because torsion spring 35, located in slot 44 (hence shown in partial ghost view), biases grip 20 in direction 76, applying a counter force against grip 20 is needed to move it up in direction 74 toward the stowed position.

The perspective view in FIG. 10 of off-hand grip assembly 4 shows it located in the stowed position by continuing to move handle 20 in direction 74 from that shown in FIG. 9. As shown in this view, indexing block 42 was further rotated about pin 30 until release dowel 32 engaged notches 52. The bias of spring 33 ensures proper mating between dowel 32 and notches 52. Once in the stowed position, dowel 32 and locking block 54 hold grip 20 in place. It is appreciated that by moving dowel 32 in direction 40 again, grip 20 is movable in direction 76 lowering it to the use position, as shown in FIG. 8. Indeed, because of the bias of torsion spring 35, grip 20 will pivot quickly or "snap" into its use position.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A gun comprising:

a hand grip attached to a body and located adjacent a trigger, a firing mechanism attached to the body, and a barrel extending from the firing mechanism;

a handguard located adjacent the barrel;

a stowable, longitudinally-extending, off-hand grip adjustably coupled to the handguard and spaced apart from the grip with the trigger located between the grip and the off-hand grip;

wherein the off-hand grip has a first end, and a second end that is distal from the first end;

wherein the off-hand grip includes a pivot located adjacent the first end such that the off-hand grip is pivotable with respect to the handguard;

wherein the off-hand grip is pivotable between a use position where the off-hand grip longitudinally extends about transverse from the barrel, and a stowed position where the off-hand grip is longitudinally adjacent the barrel;

wherein the off-hand grip includes an indexing block at one end, wherein the indexing block includes first and second notches, wherein a bar is disposed therethrough and about which the off-hand grip pivots; and a locking block located between the barrel and the handguard, wherein the locking block is coupled to the bar and movable with the bar as the bar engages and disengages to and from either the first or second notch.

2. The gun of claim 1, further comprising a bar about which the off-hand grip pivots.

3. The gun of claim 1, wherein the indexing block is U-shaped and configured to receive a portion of the locking block when the bar is engageable with at least the first notch.

4. The gun of claim 1, wherein a portion of the bar is located exterior of the handguard, and wherein the bar is configured to be movable with respect to the indexing block by the portion of the bar located exterior of the handguard.

5. A gun comprising:

a hand grip attached to a body and located adjacent a trigger, a firing mechanism attached to the body, and a barrel extending from the firing mechanism;

a handguard located adjacent the barrel;

a stowable, longitudinally-extending, off-hand grip adjustably coupled to the handguard and spaced apart from the grip with the trigger located between the grip and the off-hand grip;

wherein the off-hand grip has a first end, and a second end that is distal from the first end;

wherein the off-hand grip includes a pivot located adjacent the first end such that the off-hand grip is pivotable with respect to the handguard;

wherein the off-hand grip is pivotable between a use position where the off-hand grip longitudinally extends about transverse from the barrel, and a stowed position where the off-hand grip is longitudinally adjacent the barrel;

wherein the off-hand grip includes a first notch, and second notch spaced apart from the first notch;

a bar located adjacent the handguard and movable with respect to the off-hand grip;

wherein the bar is engageable with the first notch when the off-hand grip is located in the use position and the bar is engageable with the second notch when the off-hand grip is located in the stowed position;

wherein the bar is selectively movable to disengage from the first and second notches which allows the off-hand grip to pivot between the use and stowed positions;

wherein the off-hand grip includes an indexing block at one end, wherein the indexing block includes the first and second notches, wherein a bar is disposed therethrough and about which the off-hand grip pivots; and a locking block located between the barrel and the handguard, wherein the locking block is coupled to the bar and movable with the bar as the bar engages and disengages to and from either the first or second notch.

6. The gun of claim 5, further comprising a bar about which the off-hand grip pivots.

7. The gun of claim 5, wherein the indexing block is U-shaped and configured to receive a portion of the locking block when the bar is engageable with at least the first notch.

8. The gun of claim 5, wherein a portion of the bar is located exterior of the handguard, and wherein the bar is configured to be movable with respect to the indexing block by the portion of the bar located exterior of the handguard.

* * * * *